US005409630A

United States Patent [19]

Lysy et al.

[11] Patent Number: 5,409,630

[45] Date of Patent: Apr. 25, 1995

[54] THICKENED STABLE ACIDIC MICROEMULSION CLEANING COMPOSITION

[75] Inventors: Regis Lysy, Olne; Maurice Marchal, Oster-Manhay, both of Belgium

[73] Assignee: Colgate Palmolive Co., Piscataway, N.J.

[21] Appl. No.: 191,222

[22] Filed: Feb. 3, 1994

[51] Int. Cl.[6] ..... C11D 3/37; C11D 7/24

[52] U.S. Cl. ..... 252/174.23; 252/174.22; 252/142; 252/146; 252/173; 252/554; 252/DIG. 2; 252/DIG. 14

[58] Field of Search ..... 252/89.1, 173, 142, 252/174.18, 174.23, DIG. 14, 174.22, 162, 550, 554, 146

[56] References Cited

U.S. PATENT DOCUMENTS 4,919,839 4/1990 Durbut et al. ..... 252/153
5,039,441 8/1991 Thomas et al. ..... 252/142
5,169,553 12/1992 Durbut et al. ..... 252/99

*Primary Examiner*—Paul Lieberman
*Assistant Examiner*—Lorna M. Douyon
*Attorney, Agent, or Firm*—Richard E. Nanfeldt; Robert C. Sullivan; Murray Grill

[57] ABSTRACT

A viscoelastic gel microemulsion acidic composition having a complex viscosity at 100 $sec^{-1}$ of about 0.01 to about 0.07 Pascal seconds, a G' value of about 0.8 to about 0.3 dynes/sq cm over a strain range of 0.001 to 0.4% and a G" value of about 0.06 to about 0.6 dynes/sq cm over a strain range of 0.001 to 0.1% which comprises approximately by weight 0.5 to 7 wt % of a nonionic surfactant having an HLB of about 0.1 to about 8.0; 0.5 to 10.0 wt. percent of a sodium paraffin sulfonate 1 to 6 wt % of a polymeric thickener; 0.1 to 2.0 wt % of an aliphatic hydrocarbon or perfume having about 6 to about 22 carbon atoms; and the balance being water.

12 Claims, No Drawings

THICKENED STABLE ACIDIC MICROEMULSION CLEANING COMPOSITION

This invention relates to a thickened stable acidic microemulsion cleaning composition and to processes for the manufacture and use thereof. More particularly, it relates to a thickened stable acidic microemulsion cleaning composition in concentrated form which is especially effective to clean oily and greasy soils from substrates such as bathroom fixtures and walls, leaving such surfaces clean and shiny without the need for extensive rinsing thereof. The thickened acidic microemulsion composition more readily clings to a vertical surface and has less tendency to sag or run down the vertical surface than these microemulsions described in U.S. Pat. Nos. 5,076,954, 4,919,839, 5,075,026 and 5,082,584. The described thickened microemulsion compositions comprise: a sodium paraffin sulfonate, a synthetic organic nonionic detergent, at least one aliphatic carboxylic acid, a water insoluble perfume or organic compound, water and an associative polymeric thickener which causes a structuring of the micelles in the composition. The interfacial tension at interfaces between dispersed and continuous phases of the emulsion of the detergent, aliphatic hydrocarbons, an aliphatic carboxylic acid and water are reduced which produces a stable acidic microemulsion at room temperature. The pH of the microemulsion is on the acid side, preferably in the range of 1 to 5, and the instant invented compositions are useful for removing lime scale and soap scum from hard substrates.

Liquid detergent compositions, usually in solution or emulsion form, have been employed as all-purpose detergents and have been suggested for cleaning hard surfaces such as painted woodwork, bathtubs, sinks, tile floors, tiled walls, linoleum, paneling and washable wallpaper. Many such preparations, such as those described in U.S. Pat. Nos. 2,560,839, 3,234,138, and 3,350,319, and British Patent Specification No. 1223739, include substantial proportions of inorganic phosphate builder salts, the presence of which can sometimes be found objectionable for environmental reasons and also because they necessitate thorough rinsing of the liquid detergent from the cleaned surface to avoid the presence of noticeable depositing of phosphate thereon. In U.S. Pat. Nos. 4,017,409 and 4,244,840 liquid detergents of reduced phosphate builder salt contents have been described but such may still require rinsing or can include enough phosphate to be environmentally objectionable. Some liquid detergents have been made which are phosphate-free, such as those described in U.S. Pat. No. 3,935,130 but these normally include higher percentages of synthetic organic detergent, which increased detergent content may be objectionable due to excessive foaming during use that can result from its presence. The previously described liquid detergent compositions are emulsions but are not disclosed to be microemulsions like those of the present invention.

Microemulsions have been disclosed in various patents and patent applications for liquid detergent compositions which may be useful as hard surface cleaners or all-purpose cleaners, and such compositions have sometimes included detergent, solvent, water and a co-surfactant. Among such disclosures are European Patent Specifications Nos. 0137615, 0137616 and 0160762, and U.S. Pat. No. 4,561,991, all of which describe employing at least 5% by weight of the solvent in the compositions. The use of magnesium salts to improve grease removing performance of solvents in microemulsion liquid detergent compositions is mentioned in British Patent Specification No. 2144763. Other patents on liquid detergent cleaning compositions in microemulsion form are U.S. Pat. Nos. 3,723,330, 4,472,291 and 4,540,448. Additional formulas of liquid detergent compositions in emulsion form which include hydrocarbons, such as terpenes, are disclosed in British Patent Specifications Nos. 1603047 and 2033421, European Patent Specification No. 0080749, and U.S. Pat. Nos. 4,017,409, 4,414,128 and 4,540,505. However, the presence of builder salts in such compositions, especially in the presence of magnesium compounds, tends to destabilize the microemulsions and therefore such builders are considered to be undesirable.

Although the cited prior art relates to liquid all-purpose detergent compositions in emulsion form and although various components of the present compositions are mentioned in the art, it is considered that the art does not anticipate or make obvious subject matter disclosed and claimed herein. In accordance with the present invention a stable thickened aqueous microemulsion cleaning composition comprises: a sodium paraffin sulfonate, a nonionic synthetic organic detergent, at least one aliphatic carboxylic acid, an associative polymer thickener, a water insoluble aliphatic hydrocarbon or perfume and water, wherein the composition has reduced interfacial tension at interfaces between dispersed and continuous phases of an emulsion of said detergents, aliphatic carboxylic acids, associative polymer thickener, aliphatic hydrocarbon or perfume and water, thereby producing a stable thickened microemulsion which is stable at temperatures in the range of 5° to 50° C. and which is at a pH in the range of 1 to 7, more preferably 1 to 5. Such a concentrated thickened acidic microemulsion is dilutable with water to at least five times its weight, to produce a diluted liquid acidic detergent composition which is a stable aqueous microemulsion which can be also useful as an all-purpose cleaning composition. Both the acidic concentrated and acidic diluted compositions are especially effective for cleaning oily and greasy soils from substrates. The instant compositions are acidic and are useful to remove lime scale and soap scum from hard surfaces such as bathroom fixtures, floors and walls.

SUMMARY OF THE INVENTION

The present invention provides an improved stable thickened acidic cleaning composition in the form of a thickened microemulsion which is suitable for cleaning vertical hard surfaces such as plastic, vitreous and metal surfaces, all of which may have shiny finishes. While the all-purpose thickened cleaning composition may also be used in other cleaning applications, such as removing oily soils and stains from fabrics, it is primarily intended for cleaning vertical hard shiny surfaces and desirably requires little or no rinsing. The improved thickened cleaning compositions of the invention exhibit good grease removal properties when used in concentrated form and leave the cleaned surfaces shiny without a need for rinsing them, and often wiping may be unnecessary. Little or no residue will be seen on the unrinsed cleaned surfaces, which overcomes one of the significant disadvantages of various prior art products, and the surfaces will shine. Surprisingly, this desirable cleaning is accomplished even in the absence of polyphosphates or other inorganic or organic detergent builder salts.

In one aspect of the invention a stable acidic thickened all-purpose hard surface cleaning composition which is especially effective in the removal of oily and greasy soil from hard surfaces is in the form of a substantially concentrated acidic thickened oil-in-water microemulsion. The aqueous thickened phase of such an o/w microemulsion usually includes, on a weight basis, 0.5 to 7% of nonionic synthetic organic detergent, 0.5 to 10% of an anionic sulfonated surfactant, 0.1 to 5% of a substantially water insoluble aliphatic hydrocarbon having about 6 to about 22 carbon atoms water insoluble or a perfume, 1.0 to 10% of at least one aliphatic carboxylic acid, about 0.5 to about 6.0 wt % of an associative polymer having little or no capability of dissolving oily or greasy soil, wherein the associative polymer thickener forms connecting bridges between the micelles of the detergents to form a structured micellar formation of the detergents, and 65 to 96% of water, said proportions being based upon the total weight of the composition. The dispersed oil phase of the o/w microemulsion is composed essentially of the water immiscible or water insoluble aliphatic hydrocarbon.

The unique properties of acidic microemulsions make them require a careful balancing of their components to ensure physical stability and clarity. Thickeners able to work and compatible with this systems are limited. Also, two other criteria further limit their selection: thickeners must be stable in acidic media especially on long term aging at high temperature and provide the appropriate rheology to have the best flow properties and optimal cling on inclined surfaces. In the literature some examples of acidic solutions are reported with alginic esters, carboxyvinyl polymers, polyether-polyols, pectins, xanthan gums or natural sepiolite. None of these examples deal with acidic microemulsion compositions. To our knowledge, the use of associative thickeners as rheology modifiers to get a thickened, clear and stable acidic microemulsion has not been previously reported.

An object of the invention is to provide a thickened microemulsion by an associate, thickeners which is able to deliver to an acidic microemulsion the following properties: controlled rheological properties with the purpose of preventing to fast run-off from vertical surfaces, flowing conveniently out of a jug and also being easily sprayed, physical stability on storage at all temperature, no viscosity loss on aging especially above ambient temperature (>35° C.) and-perfect product clarity.

DETAILED DESCRIPTION OF THE INVENTION

The concentrated thickened microemulsion comprise approximately by weight: 0.5 to 10% of a sulfonated surfactant, 5 to 7% of nonionic synthetic organic detergent, 0.1 to 5% of a water insoluble aliphatic hydrocarbon or a water insoluble perfume, 1.0 to 6% of associative polymeric thickener, 0.1 to 15% of at least an aliphatic carboxylic acid which is preferably a dicarboxylic acid and 66 to 96% of water. At such concentrations, upon dilution of one part of the thickened acidic concentrate with four parts of water, the resulting microemulsion will be low in detergent and solvent contents, which is desirable to avoid excessive foaming and to prevent destabilization of the emulsion due to too great a content of lipophilic phase therein after dissolving in the aliphatic hydrocarbon or other solvent of the oily or greasy soil to be removed from a substrate to be cleaned. Because of the absence of builders when the cleaning composition consists of or consists essentially of the described components (with minor proportions of compatible adjuvants being permissible), a chalky appearance of the clean surface is avoided and rinsing is obviated. Among the desirable adjuvants that may be present in the thickened microemulsions are divalent or polyvalent metal salts, as sources of magnesium and aluminum, for example, which improve cleaning performances of the dilute compositions at a concentration of about 0.1 to 3.0 wt. % and higher fatty acids and/or higher fatty acid soaps, which act as foam suppressants and act as a medium structuring agent to obtain a minor emulsion. The structuring agent is present at a concentration of about 0.1 to 3.0 wt. %. An especially preferred structuring agent is magnesium sulfate heptahydrate. Of course, if it is considered aesthetically desirable for the normally clear microemulsions to be cloudy or pearlescent in appearance, an opacifying or pearlescing agent may be present and in some instances, when it is not considered disadvantageous to have to rinse the builder off the substrate, builder salts, such as the polyphosphates, may be present in the thickened microemulsions, but it should be stressed that normally in the thickened acidic microemulsions usually builders will be absent from them.

Although most of the thickened acidic microemulsions of this invention are of the oil-in-water (o/w) type, some may be water-in-oil (w/o), especially the concentrates. However, the preferred thickened detergent compositions are oil-in-water thickened acidic microemulsions, with the essential components thereof being an anionic sulfonated or sulfated surfactant nonionic detergent, at least one aliphatic carboxylic acid, water insoluble aliphatic hydrocarbon or perfume, associative polymeric thickener, and water.

The thickened acidic compositions, when diluted with water, have the capacity to solubilize up to about 8 times or more (based on the weight of the aliphatic hydrocarbon or perfume) of oily and greasy soil, which is loosened and removed from a substrate by action of the anionic and nonionic detergents (which may be referred to as a surfactant) and is dissolved in the oil phase of the o/w microemulsion. Such unexpectedly beneficial solubilizing action of the water insoluble perfume or aliphatic hydrocarbon, or dispersed phase, is also attributable to the very small (sub-micron) particle sizes of the globular dispersed liquid "particles," which constitute the dispersed oily phase, because such particles have greatly increased surface areas and consequent increased solubilizing activity.

Typically in water based detergent compositions, the presence of a "solubilizer," at a concentration of about 0.1 to 3.0 wt. % might be required. Typical solubilizers are an alkali metal lower alkyl aryl sulfonate hydrotrope, triethanolamine, urea, etc., has been required to dissolve or satisfactorily disperse aliphatic hydrocarbons, especially at aliphatic hydrocarbon levels of about 1% and higher, because aliphatic hydrocarbons are normally mixtures of essential oils and odoriferous compounds which are essentially water insoluble. Therefore, by incorporating the aliphatic hydrocarbons or perfume into the aqueous acidic cleaning composition as the oil phase of the ultimate o/w thickened acidic microemulsion detergent composition, several different important advantages are achieved.

First, any need for use of solubilizers, which do not contribute significantly to cleaning performance, is eliminated.

Second, an improved grease removal capacity in uses of both the concentrated and diluted acidic cleaning compositions results, without any need for the presence of buffers, at both neutral and acidic pHs and at low levels of active ingredients, and improved cleaning performances are obtainable.

The water soluble aliphatic hydrocarbons used in the instant thickened acidic microemulsion composition can be straight chained or branched chained hydrocarbons having about 6 to about 22 carbon atoms, more preferably about 8 to about 18 carbon atoms and most preferably about 9 to about 14 carbon atoms, wherein the most preferred aliphatic hydrocarbon is decane.

The concentration of the aliphatic hydrocarbon in the thickened acidic microemulsion is about 0.1 to about 5 wt %, more preferably about 0.2 to about 2.0 wt %.

The water soluble or water dispersible nonionic synthetic organic detergents that are employed in the invented acidic cleaning compositions are usually condensation products of an organic aliphatic or alkylaromatic hydrophobic compound and ethylene oxide, which is hydrophilic. Almost any hydrophobic compound having a carboxy, hydroxy, amide or amino group with a free hydrogen present can be condensed with ethylene oxide or with polyethylene glycol to form a nonionic detergent. The length of the polyethyloxy chain of the condensation product can be adjusted to achieve the desired balance between the hydrophobic and hydrophilic elements (HLB) and such balances may be measured by HLB numbers.

Particularly suitable nonionic detergents are the condensation products of a higher aliphatic alcohol, containing about 8 to 18 carbon atoms in a straight or branched chain configuration, condensed with about 2 to 30, preferably 5 to 9 moles of ethylene oxide. A particularly preferred compound is $C_{10-14}$ alkanol ethoxylate of five ethylene oxides per mole (6.5 EO), which also may be designated as $C_{10-14}$ alcohol EO 5:1, $C_{12-15}$ alkanol ethoxylate (6.5 EO) or $C_{12-15}$ alcohol EO 6.5:1 is also preferred. Such nonionic detergents are commercially available from Shell Chemical Co. under the trade names Dobanol 23-65, Dobanol 91-5 and Neodol 25-7.

Other suitable nonionic detergents are the polyethylene oxide condensates of one mole of alkyl phenol containing from about 6 to 12 carbon atoms in a straight or branched chain configuration, with about 2 to 30, preferably 2 to 15 moles of ethylene oxide, such as nonyl phenol condensed with 9 moles of ethylene oxide, dodecyl phenol condensed with 15 moles of ethylene oxide, and dinonyl phenol condensed with 15 moles of ethylene oxide. These aromatic compounds are not as desirable as the aliphatic alcohol ethoxylates in the invented compositions because they are not as biodegradable.

Another well-known group of usable nonionic detergents is marketed under the trade name "Pluronics." These compounds are block copolymers formed by condensing ethylene oxide with a hydrophobic base formed by the condensation of propylene oxide with propylene glycol. The molecular weight of the hydrophobic portion of the molecule is of the order of 950 to 4000, preferably 1200 to 2500. The condensation of ethylene oxide with the hydrophobic moiety increases the water solubility of the molecule. The molecular weight of these polymers is in the range of 1000 to 15,000 and the polyethylene oxide content may comprise 20 to 80% thereof.

A most preferred nonionic detergents are a condensation product of a $C_{10-16}$ alkanol with a heteric mixture of ethylene oxide and propylene oxide. The mole ratio of ethylene oxide to propylene oxide is from 20 to 1, preferably from 3 to 4, with the total weight of the ethylene oxide and propylene oxide contents (including the terminal ethanol group or propanol group) being from 60 to 85%, preferably 70 to 80%, of the molecular weight of the nonionic detergent. Preferably, the higher alkanol contains 12 to 15 carbon atoms and a preferred compound is the condensation product of $C_{13-15}$ alkanol with 4 moles of propylene oxide and 7 moles of ethylene oxide. Such preferred compounds are commercially available from BASF Company under the trade name Lutensol LF.

Also suitable for incorporation in the invented acidic cleaning compositions are the nonionic detergents that are derived from the condensation of ethylene oxide with the product resulting from the reaction of propylene oxide and ethylene diamine. For example, satisfactory such compounds contain from about 40 to 80% of polyoxyethylene by weight, have a molecular weight of from about 5000 to 11,000 and result from the reaction of ethylene oxide with a hydrophobic base which is a reaction product of ethylene diamine and excess propylene oxide, and which is of a molecular weight in the range of 2500 to 3000.

Additionally, polar nonionic detergents may be substituted for the generally non-polar nonionic detergents described above. Among such polar detergents are those in which a hydrophilic group contains a semipolar bond directly between two atoms, for example, N—O and P—O. There is charge separation between such directly bonded atoms but the detergent molecule bears no net charge and does not dissociate into ions. Suitable such polar nonionic detergents include open chain aliphatic amine oxides of the general formula $R^7—R^8—R^9N—O$ wherein $R^7$ is an alkyl, alkenyl or monohydroxyalkyl radical having about 10 to 16 carbon atoms and $R^8$ and $R^9$ are each selected from the group consisting of methyl, ethyl, propyl, ethanol, and propanol radicals. Preferred amine oxides are the $C_{10-16}$ alkyl dimethyl and dihydroxyethyl amine oxides, e.g. lauryl dimethyl amine oxide and lauryl myristyl dihydroxyethyl amine oxide. Other operable polar nonionic detergents are the related open chain aliphatic phosphine oxides having the general formula $R^{10}R^{11}R^{12}P—O$ wherein $R^{10}$ is an alkyl, alkenyl or monohydroxyalkyl radical of a chain length in the range of 10 to 18 carbon atoms, and $R^{11}$ and $R^{12}$ are each alkyl or monohydroxyalkyl radicals containing from 1 to 3 carbon atoms. As with the amine oxides, the preferred phosphine oxides are the $C_{10-16}$ alkyl dimethyl and dihydroxyethyl phosphine oxides.

The concentration of the nonionic surfactant in the thickened acidic microemulsion is about 0.5 to about 7 wt %, preferably about 1 to about 6 wt. %.

Many other suitable nonionic detergents that may be derisive components of the present acidic microemulsion cleaning compositions are described in texts denoted to detergency, detergent compositions and components, including *Surface Active Agents (Their Chemistry and Technology)* by Schwartz and Perry, and the various annual editions of John W. McCutcheon's *Detergents and Emulsifiers.*

The paraffin sulphonates (A) used in the compositions of the present invention are usually mixed secondary alkyl sulphonates having from 10 to 20 carbon atoms per molecule; preferably at least 80%, usually at least 90%, of the alkyl groups will have 13–17 carbon atoms per molecule. Where the major proportion has 14–15 carbon atoms per molecule, optimum foaming performance appears to be obtained at varying concentrations and water hardnesses.

Another useful sulfonated anionic surfactant is a linear sodium alkyl benzene sulfonate (LAS) which is characterized by the formula:

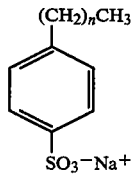

wherein n is from about 9 to about 15.

The higher alkyl ether sulphates (C) used in the compositions of the present invention are represented by the formula:

$$RO(C_2H_4O)_nSO_3X$$

in which R represents a primary or secondary alkyl group that may be straight or branched having from 10 to 18 carbon atoms, preferably from 12 to 15, X is a suitable water soluble cation, as hereinafter defined, and n is from 1 to 10, preferably from 1 to 6. these sulphates are produced by sulphating the corresponding ether alcohol and then neutralizing the resulting sulphuric acid ester.

The cation of the paraffin sulphonate (A) and the alkyl ether sulphate (C) may be an alkali metal (e.g. sodium or potassium), an alkaline earth metal (e.g. magnesium), ammonium or lower amine (including alkylolamines). It is preferred to use the sodium salt of the paraffin sulphonic acid and a sodium salt of the alkyl ether sulphuric acid ester oxide, dodecyl phenol condensed with 15 moles of ethylene oxide, and dinonyl phenol condensed with 15 moles of ethylene oxide. These aromatic compounds are not as desirable as the aliphatic alcohol ethoxylates in the invented compositions because they are not as biodegradable.

The thickened compositions of the instant invention contain about 1 to about 10 wt %, more preferably about 1 to about 8.0 wt % of at least one acidic component. Representative members of the acidic component are aliphatic carboxylic acids include $C_3$ to $C_6$ alkyl and alkenyl monobasic acids and dibasic acids such as glutaric acid and mixtures of glutaric acid with adipic acid and succinic acid, as well as mixtures of the foregoing acids.

In the thickened acidic microemulsion of the instant invention, the interfacial tension or surface tension at the interfaces between the lipophile droplets and the continuous aqueous phase is greatly reduced to a value close to 0 ($10^{-3}$ dynes/sq cm). This reduction of the interfacial tension results in spontaneous disintegration of the dispersed phase globules or droplets until they become so small that they cannot be perceived by the unaided human eye. In such a microemulsion state, thermodynamic factors come into balance, with varying degrees of stability being related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation of the microemulsion. A thermodynamically stable system is achieved when interfacial tension or free energy is minimized and when droplet dispersion entropy is maximized. Thus, it appears that the role of the associative polymeric thickener in formation of a stable o/w microemulsion is to decrease interfacial tension and to create an improved microemulsion structure and increase the number of possible configurations. Also, it seems likely that the associative polymer thickener helps to modify rigidity of the dispersed phase with respect to the continuous phase and with respect to the oily and greasy soils to be removed from surfaces to be contacted by the thickened acidic microemulsions.

The polymeric thickeners for use in the acidic microemulsion are low molecular weight associative thickeners with a dumbell-like structure.

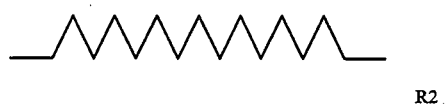

They are marketed by AKZO under the Dapral T 210 and 210 trademark. The average molecular weight of these polymers is about 6,000 to about 12,000. Both have a symmetrical structure with alkyl groups in C18; R1=R2 and R3 is an ethylene oxide-propylene oxide chain {(EO)n(PO)m}. The Dapral T212 is more hydrophobic than the Dapral T210.

Although they are not soluble in water, these thickeners work in aqueous formulations with surfactants. The microemulsion thickening and stabilizing mechanism can be regarded some what as hybrid with mostly hydrophobic effect but also contribution of the hydrophilic part. The low molecular weight alkyl chain leads to hydrophobic interactions. The comicellization with the surfactant with both parts of the thickener being in various micelle's provides a structure to thicken the media. The high molecular weight hydrophilic chain solution result also in a structuring and some thickening of the water phase. Better stability is obtained from a simultaneous thickening of both water and oil phases. Thickening through intermolecular association mechanism—here essentially hydrophobic—is also insensitive to pH and presence of electrolytes. Also the hydrophobic—hydrophilic structure of these thickeners makes superfluous the introduction of a coupling agent, most often needed to enhance or get product clarity when a thickener is introduced in a oil in water composition. Some typical compositions are shown in annex 1. The thickened acidic microemulsion flows as a Newtonian fluid. Dynamic rheological measurements indicate that the viscous contribution is the most important. Furthermore, the Dapral does not impair soap scum and lime scale removal performances. The use of these associative thickening approach can also be extended to other acidic cleaning compositions such as toilet boil cleaners.

The organic non-polar or weakly polar hydrocarbon or water insoluble perfumes of the present compositions, is lipophilic, and is a suitable perfume or oil such as a non-polar oil which is preferably an aliphatic hydrocarbon of about 5 to about 25 carbon atoms and has the formula $C_nH_{2n+2}$, wherein n is 5 to 25, more preferably 6 to 16. Such an aliphatic hydrocarbon is desirably a normal paraffin or an isoparaffin and, of these, those which are saturated and of 6 to 16 carbon atoms are preferred, with isoparaffins of 8 to 18 carbon atoms being also preferred. The most preferred aliphatic hydrocarbon solvent is decane. The non-polar solvent or weakly polar solvent has a Hansen dispersion solubility parameter at 25° C. of at least 10 $(MPa)^{\frac{1}{2}}$, more preferably at least about 14.8 $(MPa)^{\frac{1}{2}}$, a Hansen polar solubility parameter of less than about 10 $(MPa)^{\frac{1}{2}}$ and a Hansen hydrogen bonding solubility parameter of less than about 15 $(MPa)^{\frac{1}{2}}$. In the selection of non-polar solvent or weakly polar solvent, important parameters to be considered are the length and configuration of the hydrophobic chain, the polar character of the molecular as well as its molar volume.

The non-polar solvent or weakly polar hydrocarbon which at 25° C. is less than 5 wt. % soluble in water, is selected from the group consisting essentially of alkanes and cycloalkanes having about 5 to about 25 carbon atoms, more preferably about 6 to about 16 carbon atoms; aryl alkyls having about 12 to 24 carbon atoms; terpenes having about 10 to about 40 carbon atoms, more preferably about 10 to about 30 carbon atoms; and esters having the formula:

$$\overset{O}{\overset{\|}{R}}COR_1$$

wherein R and $R_1$ are alkyl groups having together about 7 to about 24 carbon atoms, more preferably about 8 to about 20 carbon atoms. Some typical non-polar solvents or weakly polar solvents are hexadecane, tetradecane, phenyl hexane, decycacetate, 2-undecanone, limonene, diethylene glycol monohexyl ether, disopropyl adipate, cetyl lactate and dioctyl malate, and mixtures thereof.

The concentration of the non-polar hydrocarbon or perfume in the composition is about 0.0 to about 5 wt. %, more preferably about 0.2 to about 4.0 wt. %.

The concentration of the associative polymeric thickener in the thickened acidic microemulsion composition is about 0.1 to about 6 wt %, more preferably about 1 to about 5 wt % and most preferably about 1 to about 4 wt %.

The final essential component of the invented thickened acidic microemulsions is water. Such water may be tap water, usually of less that 150 ppm hardness, as $CaCO_3$, but preferably will be deionized water or water of hardness less than 50 ppm, as $CaCO_3$. The proportion of water in the concentrated microemulsions is from about 66 to about 90 wt % and more preferably about 70 to about 90 wt %.

The thickened concentrated o/w acidic microemulsion liquid all-purpose cleaning compositions of this invention are effective when used as is, without further dilution by water, but it should be understood that some dilution, without disrupting the microemulsion, is possible and often may be preferable, depending on the levels of the components present in the composition.

It is within the scope of this invention to formulate various concentrated thickened microemulsions which will be diluted with additional water before use.

The concentrated thickened acidic microemulsions, like other such emulsions previously mentioned, can be diluted by mixing with up to about 20 times or more, even sometimes to 100 times, but preferably about 3 or 4 to about 10 times their weight of water, e.g. 4 times, to form o/w microemulsions. While the degree of dilution is suitably chosen to yield an o/w microemulsion composition after dilution, it should be recognized that during the course of dilution, especially when diluting from w/o thickened concentrated emulsions, both microemulsion and non-microemulsion stages may be encountered.

The all-purpose thickened acidic microemulsion cleaning composition of this invention may, if desired, also contain other components, either to provide additional beneficial effects or to make the product more attractive to the consumer. The following are mentioned by way of examples: 0.1 to 5 wt. % of a solubilizing agent such as magnesium sulfate or aluminum sulfate colors or dyes in proportions of 0.05 to 0.5%; bactericides in proportions of 0.05 to 1%; preservatives such as potassium benzoate or antioxidizing agents, such as formalin, 5-bromo-5-nitrodioxan-1,3,5-chloro-2-methyl-4-isothaliazolin-3-one, 2,6-di-tert, butyl-p-cresol, in proportions of 0.05 to 2%; and pH adjusting agents such as sulfuric acid or sodium hydroxide, as needed. Furthermore, if opaque or pearlescent compositions are desired, up to 4% by weight of opacifier and/or pearlescing agent may be added.

The thickened microemulsion can also, optionally, contain an anticorrosion system comprising a mixture of 0.1 to 0.5 wt. % of phosphoric acid and 0.01 to 1.0 wt. % of amino trimethyl phosphonic acid.

If the concentrated acidic thickened microemulsion is diluted to form an oil-in-water acidic microemulsion, the acidic thickened microemulsion will exhibit stability at reduced and increased temperatures. More specifically, such diluted formed acidic thickened microemulsion is stable in the range of 5° C. to 50° C., especially 10° C. to 43° C. The thickened microemulsions exhibit a pH in the acidic range, e.g. 1–4, 2–3.5 being considered best for lime scale and soap scum removal applications. The thickened acidic microemulsion liquids exhibit a complex viscosity in the range of 0.01 to 0.1 Pascal seconds at a frequency of 1 $sec^{-1}$, more preferably about 0.03 to about 0.07 Pascal seconds, an elastic modulus G' value of about 0.8 to about 0.3 dynes/sq cm over a strain range of 0.001 to 0.1 and a viscous modulus G'' value of about 0.06 to about 0.4 dynes/sq cm over a strain range of 0.001 to 0.1%. The thickened acidic microemulsions exhibit viscoelastic gel-like properties.

The thickened compositions, in either concentrated or diluted form, are ready for direct use or can be diluted as desired before application. In either case little or no rinsing is usually required and substantially no residue or streaks are left behind. Furthermore, because the compositions are preferably free of detergent builders, such as alkali metal polyphosphates, they are environmentally acceptable and provide the additional benefit of a better "shine" on cleaned hard surfaces without the need for rinsing. When rinsing is considered desirable, the amount of water used for the rinse may be minimized, often being less than 10 times the weight of the microemulsion applied.

The thickened liquid acidic compositions are preferably packaged in containers of synthetic organic polymeric plastic, e.g. PVC, polyethylene or polypropylene.

The compositions prepared are thickened acidic microemulsions and often no particular mixing procedure is required to be followed to cause formation of the desired thickened acidic microemulsions, the compositions are easily prepared, often simply by combining all of the components thereof in a suitable vessel or container. The order of mixing the ingredients in such cases is not particularly important and generally the various materials can be added sequentially or all at once or in the form of aqueous solutions. It is not necessary to use elevated temperatures in the manufacturing of the thickened acidic microemulsions, room temperature being sufficient, with temperatures in the range of 5° to 50° C. being satisfactory. To reduce 1 manufacturing time, it is better to process at higher temperature than ambient e.g. 40°-50° C. However, to avoid any problems with emulsions breaking or not forming properly it is preferred to make a solution of the synthetic detergents and aliphatic carboxylic acid in water, dissolve the polymer associative therein, and then admix in the aliphatic hydrocarbon, which thus spontaneously forms the thickened acidic concentrated microemulsion, which operations are conducted at a temperature in the 5° to 50° C. range, preferably 10° to 43° C. and more preferably 20° to 30° C. Dilute microemulsions can be made from the concentrated thickened acidic microemulsion by dilution with at least 50% thereof of water, with both the thickened acidic microemulsion and the water being in the described temperature range. The products resulting are of dispersed lipophilic phase droplet sizes in the range of 25 to 800 Å, preferably 25 to 200 Å, with the smaller particle size promoting better absorption of oily soils from soiled substrates to be cleaned.

The following examples illustrate liquid cleaning compositions of the present invention. Unless otherwise specified, all percentages and parts given in these examples, this specification and the appended claims are by weight and all temperatures are in °C. The exemplified compositions are illustrative only and do not limit the scope of the invention.

EXAMPLE 1

The following examples were prepared wherein the amounts as stated are in weight percent.

| | A | B | C | D | E | F | G |
|---|---|---|---|---|---|---|---|
| 60% Cl4–Cl7 Paraffin Sulfonate NA | 6.67% | 6.67% | 6.67% | 6.67% | 6.67% | 6.67% | 6.67% |
| Cl3–Cl5 Fatty ALcohol EO 10:1/PO 5:1 | 3.00% | 3.00% | 3.00% | 3.00% | 3.00% | 3.00% | 3.00% |
| Acid Mixture Succinic/Adipic/ Glutaric | 5.00% | 5.00% | 5.00% | 5.00% | 5.00% | 5.00% | 5.00% |
| -DAPRAL T212 | | 3.00 | 1.40 | 3.50 | 4.00 | 4.50 | 6.00 |
| -DAPRAL T210 | | — | 1.80 | — | — | — | — |
| 75% Phosphoric Acid | 0.267% | 0.267% | 0.267% | 0.267% | 0.267% | 0.267% | 0.267% |
| Amino Trimethyl Phosphonic Acid | 0.05% | 0.05% | 0.05% | 0.05% | 0.05% | 0.05% | 0.05% |
| Magnesium Sulfate Heptahydrate | 1.50% | 1.50% | 1.50% | 1.50% | 1.50% | 1.50% | 1.50% |
| Potassium Benzoate | 0.30% | 0.30% | 0.30% | 0.30% | 0.30% | 0.30% | 0.30% |
| Frescodore Perfume | 0.80% | 0.80% | 0.80% | 0.80% | 0.80% | 0.80% | 0.80% |
| Deionized Water | Bal | Bal | Bal | Bal | Bal | Bal | Bal |
| pH | 3.0 | 3.0 | 3.0 | 3.0 | 3.0 | 3.0 | 3.0 |
| *Brookfield (cps) | | 40 | 38 | | | | |
| **Raymond (sec) | | 12 | 11 | 19 | 26 | 41 | 45 |

The formulas were prepared by making an aqueous solution of ½ the formula amount of the paraffin sulfonate. To this solution at about 40°-50° C. with mixing was added the Dapral followed by the balance of the paraffin sulfonate and then with mixing was added the nonionic surfactant, the acid mixture, and then the balance of the minor ingredients.

The invented subject matter has been described with respect to various embodiments and working examples but it is not to be construed as limited to these because it is evident that one of skill in the art, with the present specification before him, will be able to utilize substitutes and equivalents without departing from the scope of the invention herein described.

What is claimed is:

1. A thickened gel microemulsion composition having a complex viscosity at $10^2$ $sec^{-1}$ of about 0.01 to about 0.07 Pascal seconds, an elastic modulus G′ value of about 0.8 to about 0.3 dynes/sq cm over a strain range of 0.001 to 0.1% and a viscous modulus G″ value of about 0.06 to about 0.6 dynes/sq cm over a strain range of 0.001 to 0.1% which comprises approximately by weight:

(a) 0.5 to 7% of a nonionic surfactant having an HLB of about 10 to about 15;

(b) 1.0 to 6.0% of a polymeric thickener characterized by the formula:

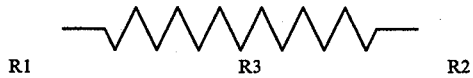

wherein R1=R2 and R1 and R2 are alkyl groups having about 16 to 20 carbon atoms and R3 is an ethylene oxide-propylene oxide chain and having a molecular weight of about 6,000 to about 12,000;

(c) 0.1 to 5% of a water insoluble aliphatic hydrocarbon having about 6 to about 22 carbon atoms or water insoluble perfume;

(d) 0.1 to 15% of at least one aliphatic carboxylic acid; and (e) 0.5 to 10.0% of a sulfonated or sulfated anionic surfactant; and (f) the balance being water.

2. A composition according to claim 1, wherein said aliphatic hydrocarbon has about 9 to 14 carbon atoms.

3. A composition according to claim 1, wherein said nonionic surfactant is a condensation product of one mole of an aliphatic alcohol having about 8 to 18 carbon atoms with about 5 to about 7 moles of ethylene oxide and propylene oxide.

4. A composition according to claim 1, wherein said nonionic surfactant is a condensation product of one mole of an aliphatic alcohol having about 10 to about 14 carbon atoms with about 6 to about 7 moles of ethylene oxide.

5. A composition according to claim 4, wherein said aliphatic hydrocarbon has about 10 to about 14 carbon atoms.

6. A composition according to claim 4, wherein said aliphatic hydrocarbon is decane.

7. A composition according to claim 1, wherein said aliphatic carboxylic acid is a $C_3$ to $C_6$ alkyl or alkenyl monobasic acid and/or dibasic acid and mixtures thereof.

8. A composition according to claim 1, wherein said anionic surfactant is a sodium paraffin sulfonate.

9. A composition according to claim 1 wherein at least one said aliphatic carboxylic acid is a mixture of succinic acid, adipic acid and glutaric acid.

10. A composition according to claim 1, further including about 0.1 to about 3.0 wt. % of a medium structuring agent.

11. A composition according to claim 10, wherein said medium structuring agent is magnesium sulfate.

12. A composition according to claim 11, further including an anticorrosion system comprising approximately by weight of an anti-corrosion system comprising 0.1 to 0.5 of phosphoric acid and 0.01 to 0.1 wt. percent of an aminotrimethyl phosphonic acid and mixtures thereof.

* * * * *